US010520260B2

(12) United States Patent
Huang et al.

(10) Patent No.: US 10,520,260 B2
(45) Date of Patent: Dec. 31, 2019

(54) HEAT PIPE

(71) Applicant: DELTA ELECTRONICS, INC., Taoyuan County (TW)

(72) Inventors: Shih-Lin Huang, Taoyuan County (TW); Chiu-Kung Chen, Taoyuan County (TW); Ti-Jun Wang, Taoyuan County (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 297 days.

(21) Appl. No.: 14/610,503

(22) Filed: Jan. 30, 2015

(65) Prior Publication Data

US 2016/0153720 A1 Jun. 2, 2016

(30) Foreign Application Priority Data

Nov. 28, 2014 (CN) ..... 2014 1 0710694

(51) Int. Cl.
*F28D 15/04* (2006.01)

(52) U.S. Cl.
CPC ..... *F28D 15/046* (2013.01)

(58) Field of Classification Search
CPC ..... H01L 23/427; F28D 15/04; F28D 15/046
See application file for complete search history.

(56) References Cited

U.S. PATENT DOCUMENTS 7,316,264 B2 1/2008 Lai et al.
8,453,718 B2 6/2013 Lee et al.
2006/0219391 A1* 10/2006 Hong ..... F28D 15/046 165/104.26
2007/0006993 A1* 1/2007 Meng ..... F28D 15/0233 165/104.26
2007/0107877 A1* 5/2007 Hou ..... F28D 15/025 165/104.26
2007/0295485 A1* 12/2007 Liu ..... F28D 15/046 165/104.26
2010/0266864 A1 10/2010 Lee
2010/0294467 A1* 11/2010 Varanasi ..... F28D 15/046 165/108
2010/0319882 A1 12/2010 Lee et al.
2011/0174464 A1* 7/2011 Liu ..... F28D 15/0233 165/104.26
2012/0111540 A1 5/2012 Dai et al.
2012/0118537 A1 5/2012 Kameoka et al.
2013/0168054 A1 7/2013 Yang

* cited by examiner

*Primary Examiner* — Frantz F Jules
*Assistant Examiner* — Schyler S Sanks
(74) *Attorney, Agent, or Firm* — Hauptman Ham, LLP

(57) ABSTRACT

A heat pipe is divided into an evaporation section, an insulation section and a condensation section. The insulation section includes a pipe section and a liquid delivery structure. The pipe section has a top wall and a bottom wall. The liquid delivery structure is a solid structure and in contact with the top and bottom walls of the pipe section. The liquid delivery structure and the top and bottom walls of the pipe section form a vapor channel. The liquid delivery structure is divided into a center portion and an outer layer, and the center portion has a porosity greater than the porosity of the outer layer. The outer layer is coupled to the center portion, and the center portion and the vapor channel are spaced from one another, so as to achieve the liquid and vapor isolation and improve the heat conducting effect of the heat pipe.

18 Claims, 5 Drawing Sheets

HEAT PIPE

FIELD OF THE INVENTION

The present invention relates to a heat conducting element, and more particularly to a heat pipe with a capillary structure and a working fluid contained therein.

BACKGROUND OF THE INVENTION

In general, a conventional heat pipe comprises a capillary structure primarily including sintered powder, grooves, meshes or fine fibers, and the capillary structure is usually distributed on the whole or a part of an internal cavity wall of the heat pipe. As to the heat pipe with the capillary structure distributed on the whole internal cavity wall, a circular core rod is generally adopted, so that the manufacturing process is simple and easy. On the other hand, the thin heat pipe has insufficient evaporation space after the heat pipe is manufactured and pressed flatly and limitation on portability, so that it is necessary to increase the effective capillary thickness. Even if the thickness is reduced below 2 mm, the thermal conductivity of the heat pipe will be very poor. To improve the insufficient liquid and vapor space of the thin heat pipe, capillary structures distributed partially on the internal cavity wall as disclosed in US Pat. Application Nos. 20070006993, 20100266864, and 20120118537 are introduced, wherein the insufficient capillary reflow and vaporization space of the pressed heat pipe can be improved by using a non-circular core rod and filling powder on a single side or both sides of the core rod, but the vapor in the cavity of the heat pipe is still in direct contact with the liquid channel, and thus the capillary reflow capability is reduced significantly, and the performance of the thin heat pipe requires improvements.

To achieve the effect of separating the liquid and vapor in the heat pipe or using plural capillary structures to separate the vapor from the liquid channel, the heat pipe structures as disclosed in U.S. Pat. Nos. 7,316,264 and 8,453,718 comprise a grooved pipe with a sintered metal powder, or a grooved pipe with a mesh to achieve the effect of separating liquid and vapor in the cavity of the heat pipe. Wherein, the vapor and the liquid channel are mainly separated by the sintered powder or mesh structure, the exterior of the capillary structure and the groove of the internal cavity wall are used as the liquid reflow channel, and the space from the interior of the capillary structure to the cavity of the heat is used as the vapor channel. Such arrangements can improve the performance of the heat pipe effectively. As to the heat pipe with the capillary structures distributed on the whole of the internal cavity wall, it is relatively difficult to manufacture a thin heat pipe with a plurality of capillary structures. As disclosed in U.S. Pat. Application Nos. 20120111540, 20100319882, and 20130168054, the structures having a non-circular core rod and powder filled on a single side or both sides of the core rod together with the groove formed on a part of the internal cavity wall are used to achieve the effect of separating liquid and vapor in the cavity of the heat pipe and improve the performance of the thin heat pipe. Due to the plurality of capillary structures, the thickness of the thin heat pipe is still limited by the capillary structures, and a thin heat pipe cannot be manufactured easily. In U.S. Pat. Application Nos. 20120111540, 20100319882, and 20130168054, although the effect of the heat pipe is still to separate the liquid and gas, yet the liquid channel acts as a grooved structure between the sintered metal powder and the upper and lower internal walls, and the vapor channel is formed on both sides of the cavity of the heat pipe. Now, the sintered metal powder does not have the direct separating effect, but it acts as a secondary liquid channel which is affected by vapor directly, so as to offset the capillary reflow capability of the sintered structure and affect the performance of the thin heat pipe.

Since the amount of heat generated by electronic products becomes increasingly larger, and the electronic products are designed and developed with high portability, thin and light, 4K video, 4G transmission, high add-on function, and multitasking computation, the conventional thin heat pipe can no longer meet the high heat and flux requirements anymore.

In view of the drawbacks of the prior art, it is a main subject of the present invention to provide a feasible design to improve the capillary structure of a flat heat pipe with a better performance and overcome the aforementioned drawbacks of the prior art.

SUMMARY OF THE INVENTION

Therefore, it is a primary objective of the present invention to provide a heat pipe with a capillary structure, and the whole or a part of the capillary structure has a portion of a higher porosity and a portion of a lower porosity, and the design of different porosities achieves a liquid and vapor isolation and improves the heat conducting effect of the heat pipe.

To achieve the aforementioned and other objectives, the present invention provides a heat pipe divided into an evaporation section, an insulation section and a condensation section, wherein the insulation section comprises a pipe section and a liquid delivery structure, and the pipe section has a top wall and a bottom wall, and the liquid delivery structure is a solid structure and in contact with the top and bottom walls, and the liquid delivery structure and the top and bottom walls of the pipe section form at least one vapor channel, and the liquid delivery structure is divided into a center portion and an outer layer, and the outer layer is coupled to the center portion, and the center portion has a porosity greater than the porosity of the outer layer, so as to achieve the liquid and vapor isolation and improve the heat conducting effect of the heat pipe.

To achieve the aforementioned and other objectives, the present invention further provides a heat pipe comprising a pipe body and a capillary structure, wherein the pipe body has a top wall and a bottom wall, and the capillary structure is installed in the pipe body, and has a liquid delivery structure which is a solid structure and in contact with the top and bottom walls, and the liquid delivery structure and the top and bottom walls form a vapor channel, and the liquid delivery structure is divided into a center portion and an outer layer, and the outer layer is coupled to the center portion, such that the center portion and the vapor channel are spaced from one another, and the center portion has a porosity greater than the porosity of the outer layer, so as to achieve the liquid and vapor isolation and improve the heat conducting effect of the heat pipe.

DESCRIPTION OF THE PREFERRED EMBODIMENTS

The technical contents of the present invention will become apparent with the detailed description of preferred embodiments accompanied with the illustration of related drawings as follows. It is noteworthy that the embodiments are provided for the purpose of illustrating the present invention only, but not intended to restrict the scope of the invention.

Figure 1:
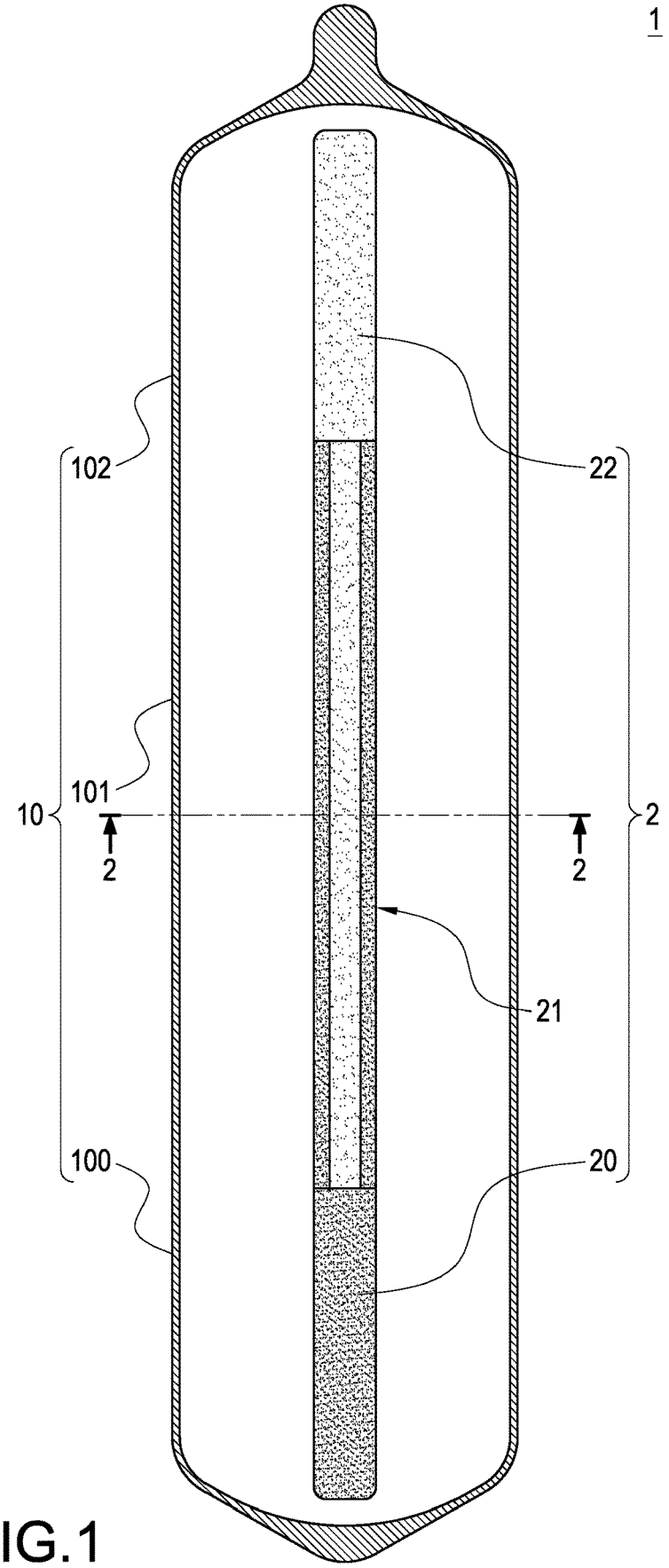
FIG. 1 is a schematic view of the internal structure of the present invention.

With reference to FIG. 1 for a schematic view of the internal structure of the present invention, the present invention provides a heat pipe 1 comprising: a pipe body 10, a capillary structure 2 installed in the pipe body 10, and a working fluid (not shown in the figure) filled into the pipe body 10. The cross-section of the pipe body 10 is in a circular tubular shape or a flat shape extended to a specific length, such that the capillary structure 2 is preferably installed in the lengthwise direction of the pipe body 10.

Figure 2:
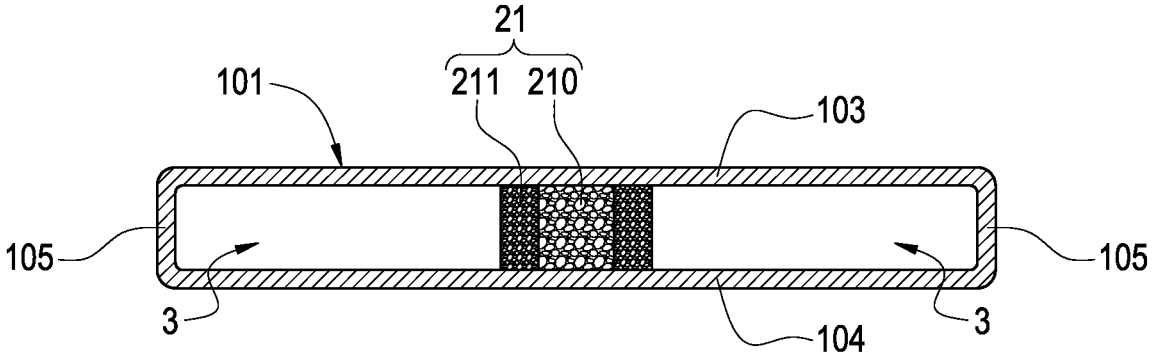
FIG. 2 is a cross-sectional view of Section 2-2 of FIG. 1.

In an embodiment as shown in FIGS. 1 and 2, the pipe body 10 is formed by integrally connecting a plurality of pipe sections, and the pipe sections are provided for dividing the pipe body 10 of the heat pipe 1 into an evaporation section 100, an insulation section 101 and a condensation section 102, and the insulation section 101 is disposed between the evaporation section 100 and the condensation section 102. The pipe body 10 or each pipe section (including the evaporation section 100, the insulation section 101 or the condensation section 102 of the pipe body 10 of the heat pipe 1) is formed by enclosing a top wall 103, a bottom wall 104 and two sidewalls 105 (as shown in FIG. 2), so that the interior of the pipe body 10 of the heat pipe 1 becomes a hollow region.

Figure 3:
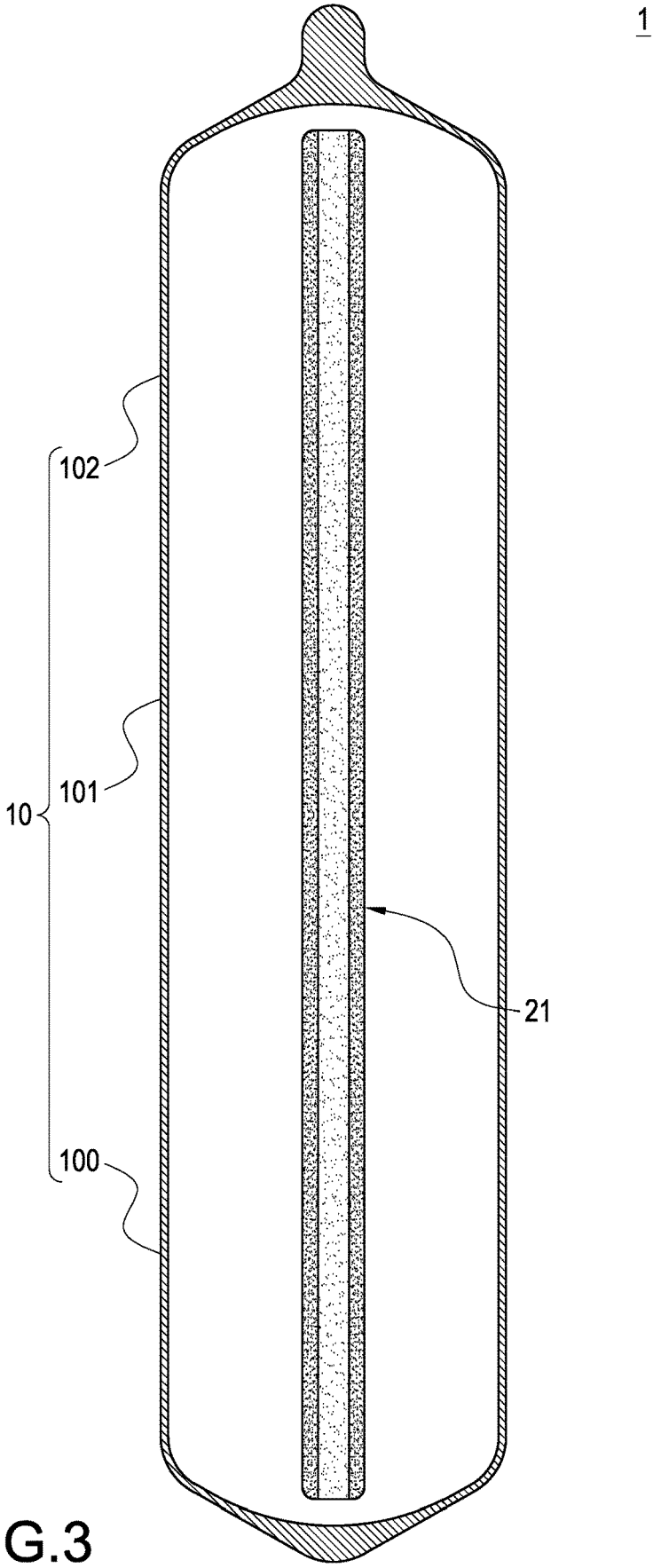
FIG. 3 is a schematic view of the internal structure of another embodiment of the present invention.
Figure 4:
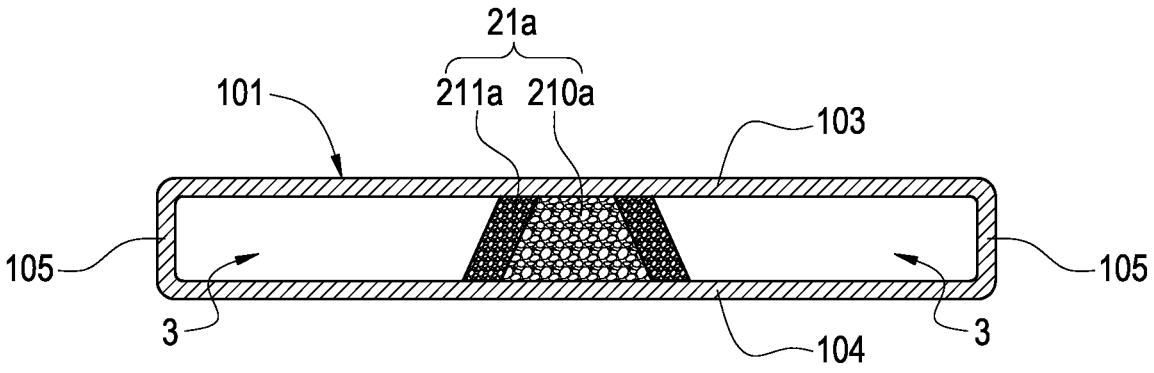
FIG. 4 is a schematic view of a second embodiment as depicted in FIG. 2.
Figure 5:
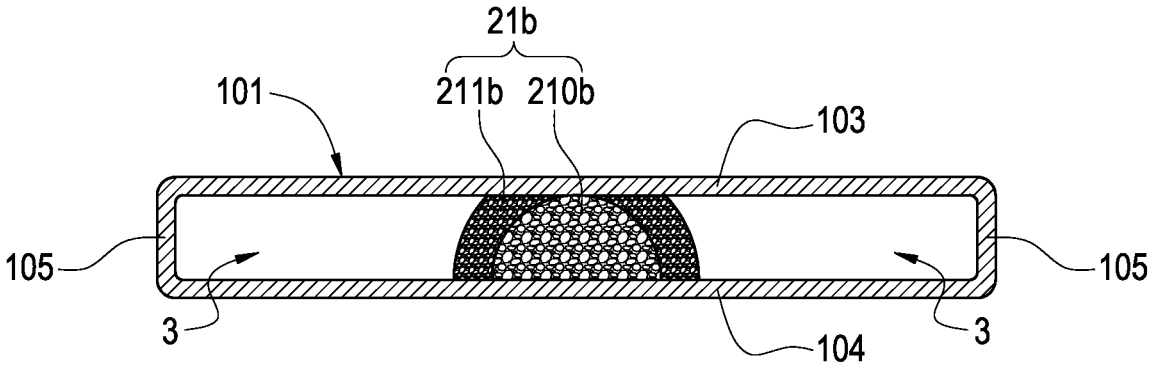
FIG. 5 is a schematic view of a third embodiment as depicted in FIG. 2.

The capillary structure 2 is installed into the aforementioned hollow region of the pipe body 10. In a preferred embodiment, the capillary structure 2 comprises a first capillary portion 20, a liquid delivery structure 21, and a second capillary portion 22, wherein the first capillary portion 20 and the second capillary portion 22 are coupled to both ends of the liquid delivery structure 21 respectively. In an embodiment as shown in FIG. 1, the first capillary portion 20 is disposed in the evaporation section 100, and the second capillary portion 22 is disposed in the condensation section 102, and the liquid delivery structure 21 is disposed in the insulation section 101. In another embodiment as shown in FIG. 3, the capillary structure 2 is formed completely by the liquid delivery structure 21. In other words, both ends of the liquid delivery structure 21 are extended into the evaporation section 100 and the condensation section 102 of the pipe body 10 respectively. The present invention is characterized in that the liquid delivery structure 21 is a solid structure, and the liquid delivery structure 21 is in contact with the pipe body 10 or the top wall 103 and the bottom wall 104 of the insulation section 101, and the liquid delivery structure 21, and the top wall 103 and the bottom wall 104 of the pipe body 10 form at least one vapor channel 3. In embodiments as shown in FIGS. 2, 4 and 5, the liquid delivery structure 21 is disposed between the two sidewalls 105, so that the vapor channel 3 can be formed jointly by the liquid delivery structure 21, the top wall 103, the bottom wall 104 and the two sidewalls. In the meantime, the liquid delivery structure 21 is divided into a center portion 210 and an outer layer 211, wherein the outer layer 211 is coupled to the center portion 210. More specifically, the outer layer 211 is cladded onto the center portion 210 or disposed between the center portion 210 and the vapor channel 3, so that the center portion 210 and the vapor channel 3 are spaced from one another, and the center portion 210 has a porosity greater than the porosity of the outer layer 211. In FIG. 2, the outer layer 211 of the liquid delivery structure 21 is vertically cladded onto the center portion 210, and the outer layer 211 and the center portion 210 form a rectangular shape. In FIG. 4, the outer layer 211*a* of the liquid delivery structure 21*a* is obliquely cladded onto the center portion 210*a*, and the outer layer 211*a* and the center portion 210*a* form a trapezium shape. In FIG. 5, the outer layer 211*b* of the liquid delivery structure 21*b* is curvedly cladded onto center portion 210*b*, and the outer layer 221*b* and the center portion 210*b* for an arc shape. Therefore, the liquid delivery structures 21, 21*a*, 21*b* may be of different shapes, and are not limited to the shapes as disclosed in the foregoing embodiments only.

More specifically, the capillary structure 2 is made of copper foam, sintered powder, or curled metal mesh, so that the first capillary portion 20, the liquid delivery structure 21 and the second capillary portion 22 may be made of any one of the aforementioned materials or made of materials different from each other. In the liquid delivery structure 21, the center portion 210 has a porosity equal to or less than 50%, and the outer layer 211 has a porosity equal to or less than 40%, but the invention is not limited to the aforementioned porosities only. Further, the porosity of the first capillary portion 20 is smaller than or equal to the porosity of the outer layer 211, and porosity of the second capillary portion 22 is greater than or equal to the porosity of the center portion 210.

In FIGS. 1 and 2, when the evaporation section 100 of the heat pipe 1 is exposed to heat, the working fluid in the evaporation section 100 changes its state from liquid to vapor, and the working liquid in the insulation section 101 flows towards the condensation section 102 for heat transfer. With the outer layer 211 of a smaller porosity, the working liquid is blocked between the center portion 210 and the vapor channel 3, so that the working fluid in a vapor state passes through the vapor channel 3 with a less resistance. After the working fluid passes through the insulation section 101, the heat is conducted to the condensation section 102. Since the working fluid in the vapor state can be cooled in the condensation section 102 and converted back to a liquid state, so that the second capillary portion 22 of the condensation section 102 can adsorb the working fluid in a liquid state, and the working fluid in the liquid state can flow along the center portion 210 and pass through the insulation section 101 without having any conflict with the working fluid in the vapor state in the vapor channel 3, and flow back to the evaporation section 100, so as to achieve the effect of conducing the heat of the working fluid in the vapor state and returning and separating the working fluid in the liquid state. The invention achieves a heat exchange in the heat pipe 1 and improves the heat conducting effect of the heat pipe.

It is noteworthy that the heat pipe 1 has a first capillary portion 20 with the porosity smaller than or equal to the porosity of the outer layer 211, and a second capillary portion 22 with the porosity greater than or equal to the porosity of the center portion 210, so that in the process of returning the liquid-state working fluid, the first capillary portion 20 provides a better adsorption effect for the return flow to flow the liquid-state working fluid back to the evaporation section 100 more quickly. In FIG. 3, the capillary structure 2 inside the heat pipe 1 may be made of the liquid delivery structure 21 only. In other words, the liquid delivery structure 21 is extended from the evaporation section 100 of the heat pipe 1 and passed through the insulation section 101 to the condensation section 102 to achieve the same effects of conducing heat of the vapor-state working fluid and returning and separating the vapor-state working fluid, or even improving the heat conducting effect of the heat pipe.

Figure 6:
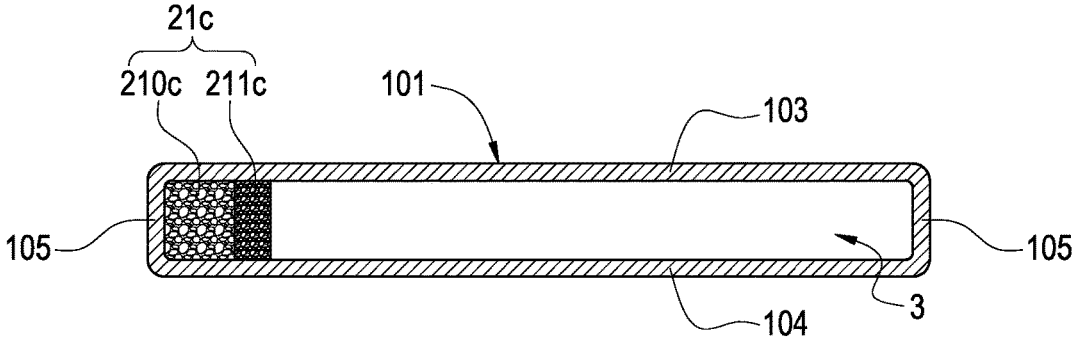
FIG. 6 is a schematic view of a fourth embodiment as depicted in FIG. 2.
Figure 7:
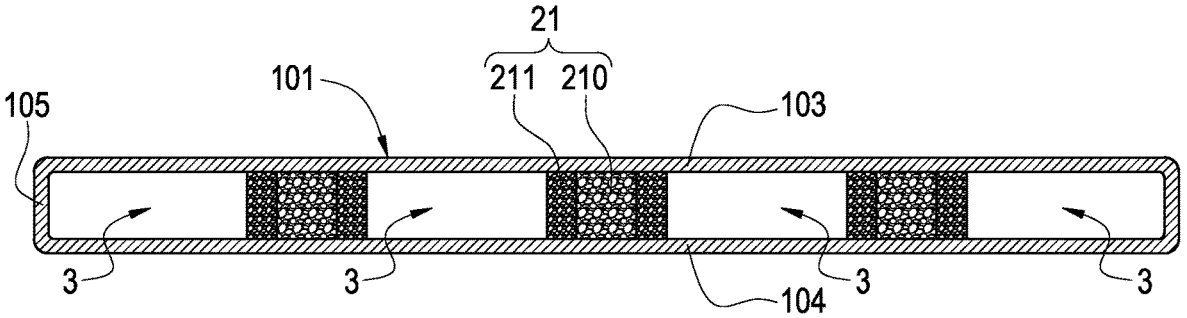
FIG. 7 is a schematic view of a plurality of liquid delivery structures in accordance with an embodiment of the present invention.

With reference to FIGS. 6 and 7 for two different embodiments of the present invention respectively, a heat pipe as shown in FIG. 6 has the liquid delivery structure 21*c* installed to a side of the pipe body 10 or the insulation section 101, so that the center portion 210*c* is in contact with one of the sidewalls 105, and the outer layer 211*c* is disposed between the center portion 210*c* and the vapor channel 3; and a heat pipe as shown in FIG. 7 has a plurality of liquid delivery structures 21 installed in the pipe body 10 of the heat pipe 1, and each liquid delivery structure 21 may be any one of the aforementioned embodiments (FIG. 7 shows another embodiment of the heat pipe as shown in FIG. 2), and the liquid delivery structures 21 are spaced from one another in the pipe body 10 and used as a support for the interior of the pipe body 10 for preventing the pipe body 10 from being depressed and deformed.

The heat pipe of the present invention achieves the effects of separating the vapor channel and the liquid reflow, overcoming the portability issue of the thin heat pipe, providing a simple and easy manufacturing process of the thin heat pipe, and improving the heat conductivity. In summation, the present invention can achieve the liquid and vapor isolation and improve the heat conducting effect of the heat pipe.

While the invention has been described by means of specific embodiments, numerous modifications and variations could be made thereto by those skilled in the art without departing from the scope and spirit of the invention set forth in the claims.

What is claimed is:

1. A heat pipe, divided into an evaporation section, an insulation section and a condensation section, and the insulation section comprising:

a pipe section, having a top wall and a bottom wall; and a liquid delivery structure, being a solid structure with porous structures, the liquid delivery structure having a top surface, two side surfaces and a bottom surface in a direction of extension of the liquid delivery structure, wherein the top surface is contacted with the top wall, and the bottom surface is contacted with the bottom wall, an outer side of the side surface of the liquid delivery structure together with the top and bottom walls of the pipe section forming at least one vapor channel, the liquid delivery structure being divided into a center portion and an outer layer, the outer layer being coupled to the center portion, and the center portion having a porosity greater than a porosity of the outer layer, wherein a first capillary portion is coupled with a first end of the liquid delivery structure and a second capillary portion is coupled with a second end of the liquid delivery structure opposite the first end, and the first capillary portion has a porosity smaller than or equal to the porosity of the outer layer, and the second capillary portion has a porosity greater than or equal to a porosity of the center portion.

2. The heat pipe of claim 1, wherein the liquid delivery structure is made of copper foam, sintered powder, or curled metal mesh.

3. The heat pipe of claim 1, wherein the outer layer is cladded onto the center portion.

4. The heat pipe of claim 1, wherein the outer layer is disposed between the center portion and the at least one vapor channel.

5. The heat pipe of claim 1, wherein the center portion has a porosity equal to or greater than 50%, and the outer layer has a porosity equal to or less than 40%.

6. The heat pipe of claim 1, wherein the pipe section has two sidewalls, and the liquid delivery structure is disposed between the two sidewalls, and the liquid delivery structure, the top and bottom walls, and the two sidewalls jointly form the at least one vapor channel.

7. The heat pipe of claim 1, wherein the pipe section has two sidewalls, and the liquid delivery structure is in contact with one of the sidewalls.

8. The heat pipe of claim 1, wherein there is a plurality of the liquid delivery structures, and the liquid delivery structures are spaced from one another in the pipe section.

9. A heat pipe, comprising:

a pipe body, having a top wall and a bottom wall; and a capillary structure, installed in the pipe body, and having a liquid delivery structure which is a solid structure with porous structures, the liquid delivery structure having a top surface, two side surfaces and a bottom surface in a direction of extension of the liquid delivery structure, wherein the top surface is contacted with the top wall, and the bottom surface is contacted with the bottom wall, an outer side of the side surface of the liquid delivery structure together with the top and bottom walls forming a vapor channel, the liquid delivery structure being divided into a center portion and an outer layer, the outer layer being coupled to the center portion, and the center portion having a porosity greater than a porosity of the outer layer, wherein the pipe body is divided into an evaporation section, an insulation section and a condensation section, and the capillary structure includes a first capillary portion coupled with a first end of the liquid delivery structure, and a second capillary portion coupled with a second end of the liquid delivery structure opposite the first end, and the first capillary portion has a porosity smaller than or equal to the porosity of the outer layer, and the second capillary portion has a porosity greater than or equal to a porosity of the center portion.

10. The heat pipe of claim 9, wherein the center portion has a porosity equal to or less than 50%, and the outer layer has a porosity equal to or less than 40%.

11. The heat pipe of claim 9, wherein the capillary structure is made of copper foam, sintered powder, or curled metal mesh.

12. The heat pipe of claim 9, wherein the outer layer is cladded onto the center portion.

13. The heat pipe of claim 9, wherein the outer layer is disposed between the center portion and the vapor channel.

14. The heat pipe of claim 9, wherein the pipe body has two sidewalls, and the liquid delivery structure is disposed between the two sidewalls so that the vapor channel is one of at least two vapor channels formed separately on both sides of the liquid delivery structure.

15. The heat pipe of claim 9, wherein the pipe section has two sidewalls, and the liquid delivery structure is in contact with one of the sidewalls.

16. The heat pipe of claim 9, wherein there is a plurality of the liquid delivery structures, and the liquid delivery structures are spaced from one another in the pipe section.

17. The heat pipe of claim 1, wherein the center portion extends from the top wall to the bottom wall, the center portion is in contact with the top and bottom walls, and the outer layer is in contact with the top and bottom walls.

18. The heat pipe of claim 9, wherein the center portion extends from the top wall to the bottom wall, the center portion is in contact with the top and bottom walls, and the outer layer is in contact with the top and bottom walls.

* * * * *